US005461888A

United States Patent [19]

Jansson et al.

[11] Patent Number: 5,461,888

[45] Date of Patent: Oct. 31, 1995

[54] SUSPENSION-TREATING DEVICE

[75] Inventors: Ulf Jansson; Rolf Ekholm, both of Karlstad, Sweden

[73] Assignee: Kvaerner Pulping Technologies Aktiebolag, Karlstad, Sweden

[21] Appl. No.: 262,507

[22] Filed: Jun. 20, 1994

[30] Foreign Application Priority Data

Apr. 21, 1994 [SE] Sweden ..... 9401345

[51] Int. Cl.[6] ..... D06B 5/26

[52] U.S. Cl. ..... 68/181 R; 162/251; 210/781; 210/366

[58] Field of Search ..... 68/181 R, 184, 68/182; 8/156; 162/251; 210/781, 780, 365, 367, 377

[56] References Cited

U.S. PATENT DOCUMENTS

| | | | |
|---|---|---|---|
| 1,496,517 | 6/1924 | Boehm | 68/181 R |
| 2,680,684 | 6/1954 | Obenshain | 162/251 |
| 3,454,163 | 7/1969 | Read | 210/781 |
| 3,524,551 | 8/1970 | Richter | 68/181 R X |
| 3,943,034 | 3/1976 | Wallen . | |
| 3,984,317 | 10/1976 | Donovan | 210/781 |
| 4,215,447 | 8/1980 | Gartland et al. | 68/181 R |
| 4,283,938 | 8/1981 | Epper et al. | 210/367 X |
| 4,646,979 | 3/1987 | Musselmann et al. | 68/181 R |
| 5,227,057 | 7/1993 | Lundquist | 210/377 |
| 5,296,152 | 3/1994 | Frykhult . | |

*Primary Examiner*—Frankie L. Stinson

*Attorney, Agent, or Firm*—Michael D. Bednarek; Marks & Murase

[57] ABSTRACT

A device for treating a preferably cellulose-containing suspension, comprising a housing (1) on a stand (2). It is characterized in that it comprises an injection chamber (8) limited by two disc-shaped wall members (9) mounted having an inner part on an axle (5) on one side each of a normal plane (S) to the axle and arranged to rotate about a center of rotation (C) common to the axle, in that the distance between the wall members (9) decreases from the axle (5) and out towards their periphery, in that at least one inlet opening (7) is disposed in the inner part of the chamber (8) for the suspension to be treated, in that outlets (27) for the treated suspension are disposed in an outer part (25) (the acceptance space) of the injection chamber (8), in that an extraction chamber (29) is disposed outside the wall members (9) of the injection chamber (8), in that openings (22) for a filtrate are disposed between the injection chamber (8) and the extraction chamber (29) within at least one annular zone of the radial extent of the wall members (9), and in that outlets (30) for a filtrate are arranged from the extraction chambers (29).

14 Claims, 5 Drawing Sheets

SUSPENSION-TREATING DEVICE

TECHNICAL FIELD

The present invention relates to a device for treating a suspension, preferably a cellulose-containing suspension. The invention also relates to a wall member which is intended to be able to be incorporated into the device.

PRIOR ART

In many pans of processes for the production of cellulose pulp or similar, the cellulose-containing suspensions are thickened or washed in order, for example, to increase the concentration somewhere in the process or in order to clean the suspension. In this case, drum filters are generally used in the thickening. A drum filter conventionally comprises a water-permeable drum up which the suspension is led for water to run off and normally produces an increase in concentration from 2–3% to 20%. In the washing operation, clean water is added in or after the drum filter. These drum filters, however, are very large and bulky. In most modern processes, efforts are being made to reduce the size of the installation in order to save costs, which is made more difficult by the conventional large drum filters. Another drawback with the drum filters is that they are difficult to control with regard to process requirements and process parameters.

BRIEF DISCLOSURE OF THE INVENTION

The object of the present invention is to offer a device for thickening and/or washing a suspension, which device is compact in its construction and can be controlled on the basis of process requirements and process parameters. This object is achieved by a device comprising a housing mounted on a stand, characterized in that it comprises an injection chamber limited by two disc-shaped wall members mounted having an inner pan on an axle on one side each of a normal plane to the axle and arranged to rotate about a centre of rotation common to the axle, in that the distance between the wall members decreases from the axle and out towards their periphery, in that at least one inlet opening is disposed in the inner part of the chamber for the suspension to be treated, in that outlets for the treated suspension are disposed in an outer part (the acceptance space) of the injection chamber, in that an extraction chamber is disposed outside the wall members of the injection chamber, in that openings for a filtrate are disposed between the injection chamber and the extraction chamber within at least one annular zone of the radial extent of the wall members, and in that outlets for a filtrate are arranged from the extraction chambers. In one embodiment, the device is provided with liquid distributors in the injection chamber, having liquid outlets or mouthpieces directed towards the outer part of the injection chamber. Additional characteristics and aspects and advantages and objects of the invention can be derived from the patent claims and from the following description of a couple of embodiments.

BRIEF DESCRIPTION OF DRAWINGS

The device according to the invention will be described in detail below in connection with two preferred embodiments and with reference to the appended drawings, in which.

DESCRIPTION OF PREFERRED EMBODIMENTS

Figure 1:
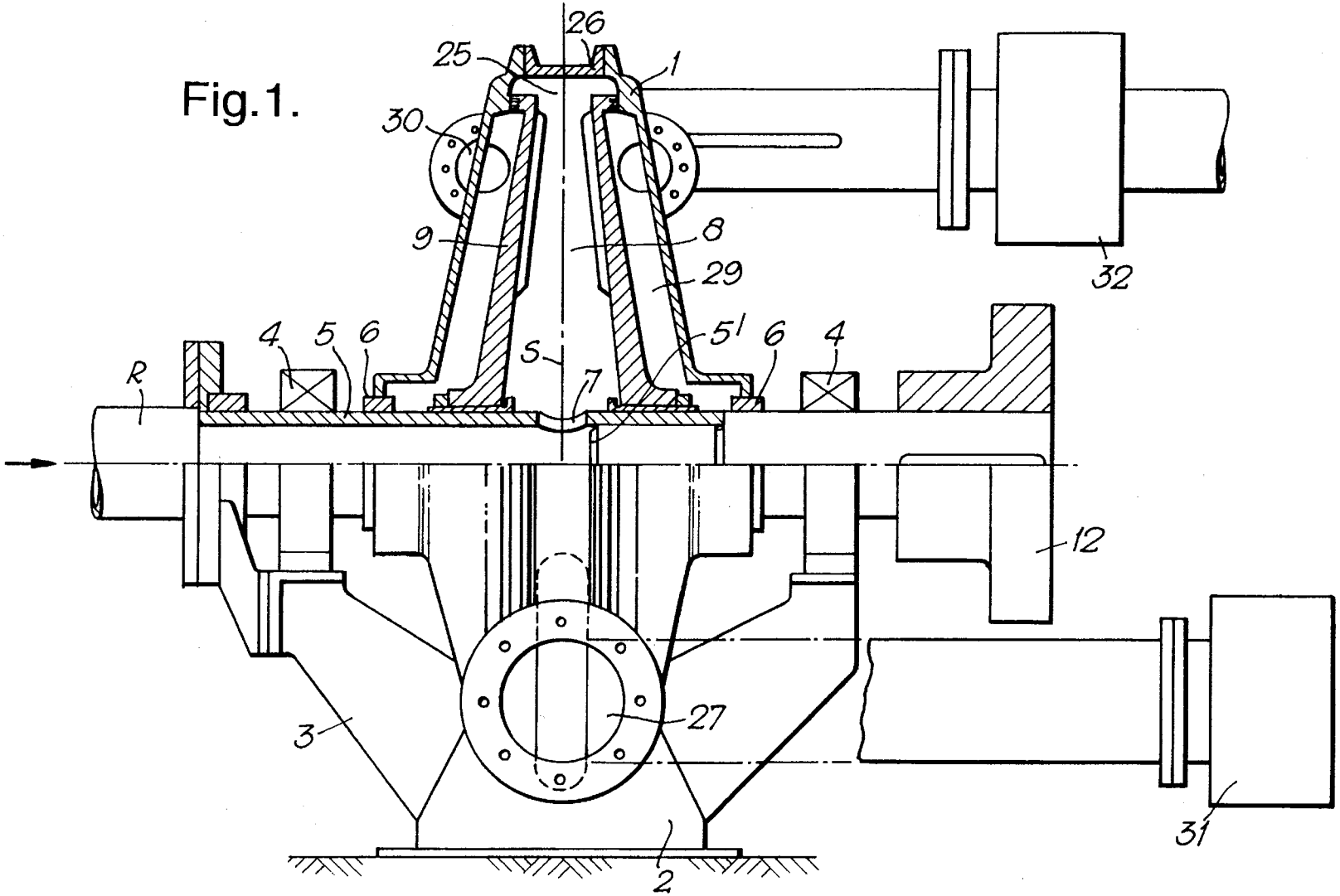
FIG. 1 shows a sideview, partially in section, of a first embodiment of the device according to the invention.
Figure 2:
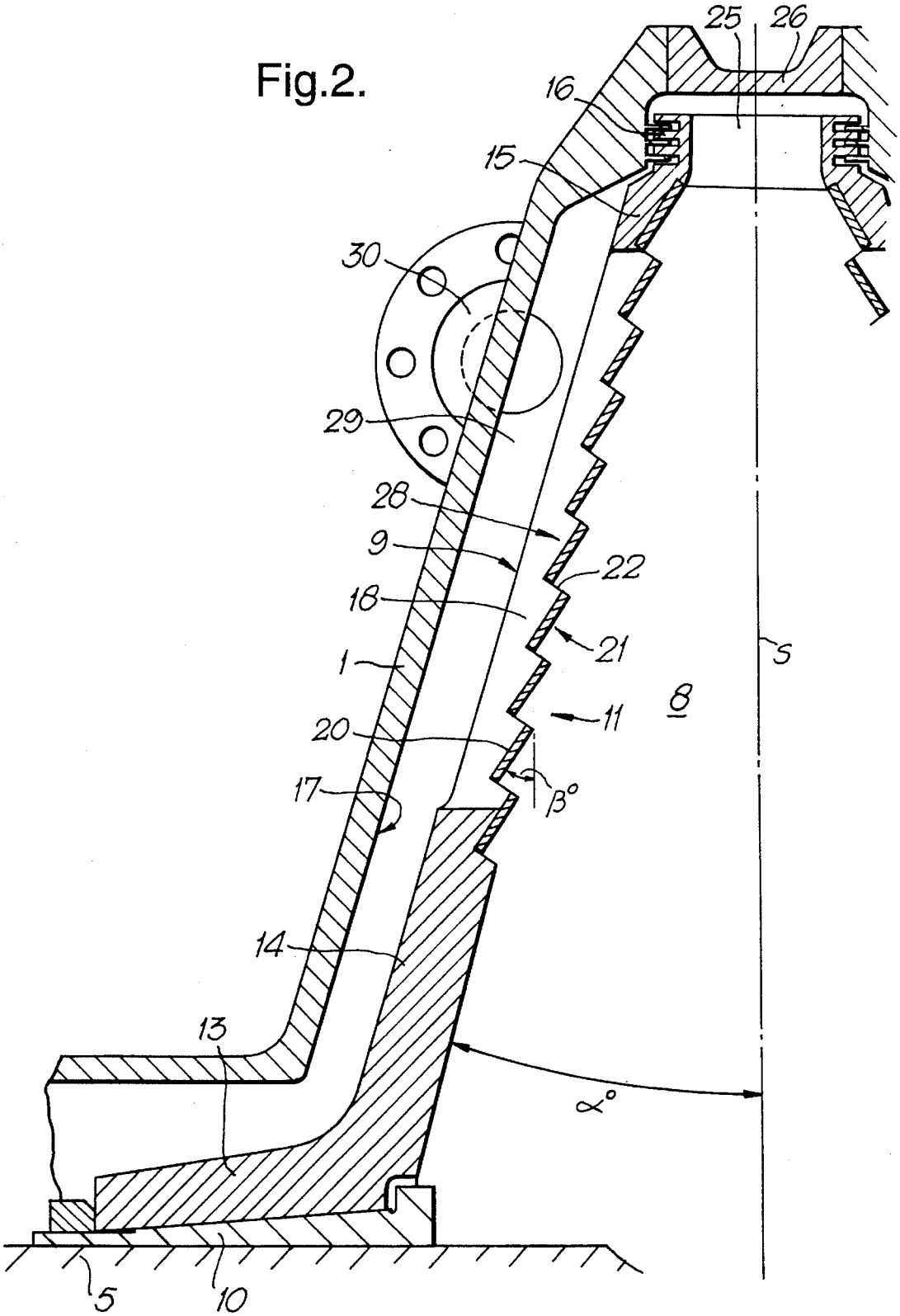
FIG. 2 shows the extraction unit of the device, partly in section.

A device according to the invention for treating a cellulose-containing suspension, which device is shown in FIGS. 1 and 2, comprises a housing 1 which is connected to a stand 2. This stand 2 is provided with arms 3, each arm having upwardly directed surfaces on which a bearing housing exhibiting bearings 4 is mounted. A hollow axle 5 is mounted rotatably in these bearings 4 and runs through the housing 1. The axle 5 forms a pipeline up to a stop wall 5' somewhat to the right of a plane of symmetry 5 belonging to the housing 1. Seals 6 are arranged in a manner known per se between the housing 1 and the axle 5. The hollow end of the axle 5 is suitably connected to a pipe system R, which distributes the suspension. The other end is connected to a suitable drive device (not shown), which can preferably be regulated in its rotational speed via transmission members 12.

The hollow axle 5 is provided with a number of radial openings 7 directly before the stop wall 5'. These openings 7 are linked to a space 8, referred to as the injection chamber, which is formed by two opposing rotary wall members 9 mounted suitably on the rotary axle, preferably by an axially adjustable wedge joint 10 in the form of a sleeve. The wall members 9 have the shape of two circular discs on either sides of the plane of symmetry S, which is perpendicular to the axle 5. The axle 5 runs through the centre of the wall members 9. In the preferred embodiment, the disc-shaped wall members 9 have straight inner walls and the distance between the mutually facing walls 11 decreases from the axle and out towards the periphery of the wall members 9, i.e. they incline towards each other, each at an angle a, FIG. 2, to the plane of symmetry S and to the normal of the axle. The injection chamber 8 therefore acquires a shape which in cross-section, viewed radially outwards from the axle 5, narrows into a wedge-shape.

The inner walls 11 of the wall members 9 can also have a different configuration than straight. They can be convexly or concavely configured, but in this case have a mean angle of inclination a.

Figure 3:
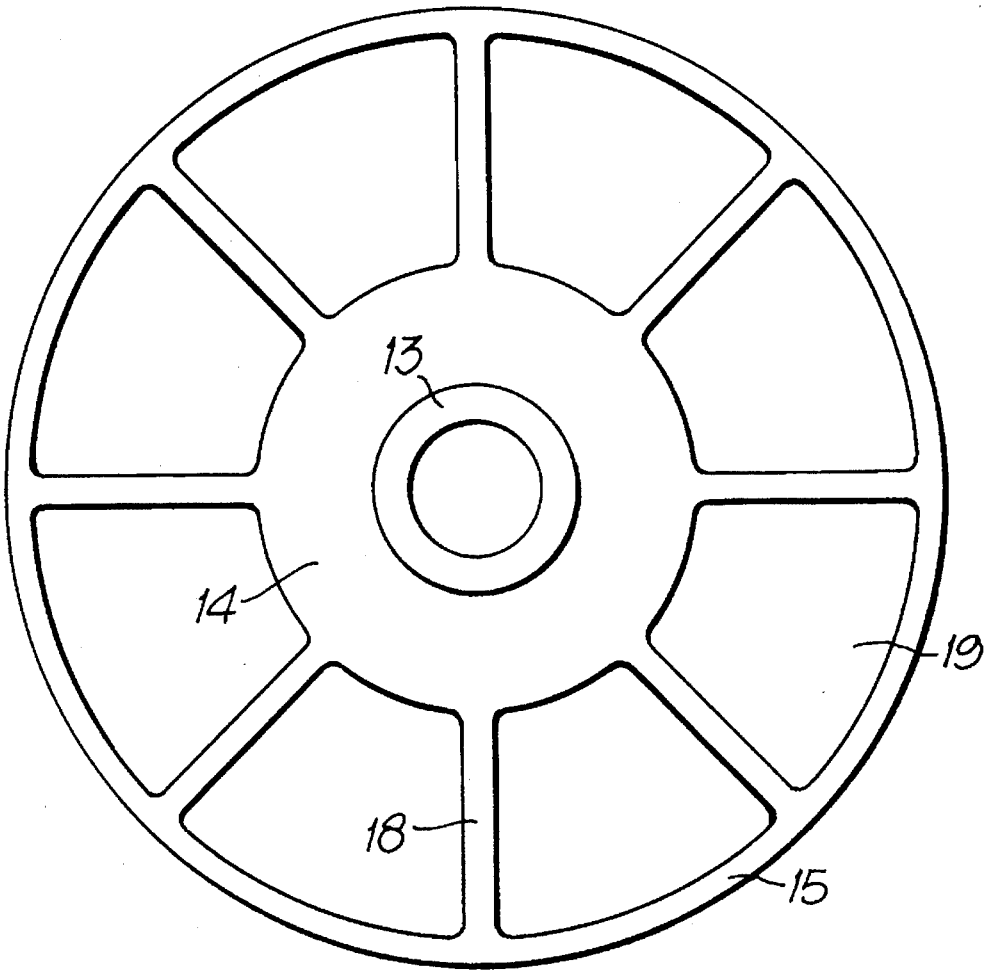
FIG. 3 shows a sideview of the wall member without separating members.

The wall members 9 are put together in the following way, FIGS. 2 and 3. They are provided at the centre with a flange 13 interacting with the sleeve-shaped wedge 10, which is axially adjustable. The flange 13 then merges into a disc-shaped segment 14. The periphery of the rotary wall member 9 is constituted by an annular part 15 provided with sealing devices 16, for example labyrinth seals, for sealing against a segment of the outer part of the inner side wall 17 of the stationary housing 1. The disc-shaped segment 14 and the annular part 15 are joined together by a number of supporting members or spokes 18. In this way, apertures 19 are formed within an annular zone of the radial extent of the wall member. These apertures 19 are arranged with separating members 20. According to the preferred embodiment, the separating members comprise annular lamellae placed concentrically in the radial direction one after the other, viewed towards the periphery of the wall members 9, and fastened suitably on the supporting members 18 and angled so that their inner surfaces 21 have an angle b, which is larger than a, to the normal of the axle. In this way, slot-shaped openings 22 are formed between the lamellae 20, which run right around the wall member 9. The lamellae 20 are made, for example, from stainless band-steel, which is shaped into rings. Other embodiments of the separating members 20 are also possible. It is therefore conceivable to use the wall members according to SE-B-446 706, which, by reference, are incorporated into this patent application, but in this case having the direction of flow in transverse direction to that which is there described there and having the separating profiles designed as rings instead of as rods.

In the peripheral part of the injection chamber 8 there is a space 25, referred to as the acceptance space, which is limited by the annular, peripheral part 15 of the wall members and by a cylindrical outer wall 26 belonging to the housing 1, which outer wall 26 connects the two side walls 17. This space 25 is connected to an essentially tangentially disposed outlet 27 for the removal of the treated suspension. The outlet has preferably the same diameter as the greatest width in respect of the acceptance space 25.

Between the outer sides 28 of each of the two wall members 9 and the housing 1 there is a space 29, referred to as extraction chamber, for the reception of the extracted medium. Each chamber 29 has an essentially tangentially disposed outlet 30. According to the embodiment, the inner side walls 17 of the housing 1 have the same inclination relative to the plane of symmetry S as the wall members 9, so that the extraction chamber 29, in cross-section, acquires a slot-shaped appearance.

By virtue of the fact that the wall members 9 are provided with sealing members 16 along their circumference, which sealing members 16 seal against the housing 1, the injection chamber 8 is able to communicate with the extraction chambers 29 only through openings 22 between the lamellae 20. The two extraction chambers 29 do not communicate with each other in the housing, but they are preferably connected, after the respective outlet 30, to a common pipe system in which any pressure variations between the two chambers are equalized.

The functional operation is as follows. The axle 5 is rotated by a motor (not shown) via the transmission members 12. The axle 5 rotates, in turn, the two wall members 9 in the stationary housing 1. The suspension to be treated is introduced into the hollow axle 5, at suitable predetermined pressure, up to the stop wall 5'. The suspension then proceeds to pass out through the radial openings 7 in the axle and into the injection chamber 8. Thanks to the inlet pressure and the rotation of the wall members 9 of the injection chamber 8, the suspension proceeds to move radially outwards. By virtue of the fact that the injection space 8 narrows down in a wedge shape, the suspension is subjected to a lateral pressure as it moves outwards. In this way, the liquid in the suspension proceeds to be pressed out through the slot-shaped openings 22 in the separating member 20 and collected in the extraction chambers 29, so as then to be led out through the outlets 30. The suspension which has been thickened finally ends up in the acceptance space 25 in the outer part of the injection chamber 8 and is removed through the outlet 27, which is preferably connected to a suitable regulating device 31 such as, for example, a speed-controlled screw pump.

The outlets 30 are provided with regulating members 32 for controlling the counter-pressure in the extraction chambers 29. The device according to the invention has a plurality of control and regulating facilities for achieving the desired process requirements. The inlet pressure of the suspension can thus be varied, as can the rotation speed of the axle 5 and the wall members 9 and hence the centrifugal force and consequently the pressure of the suspension against the walls of the injection chamber 8. In addition, the outlets for the separated-off liquid (rejects) and for the treated suspension are provided with regulating devices in the form of check valves, for example. In this way, the quantity of liquid in the treated suspension can be controlled by the combination of inlet pressure/pressure against the wall members and the counter-pressure in the extraction chamber. Thanks to the facility for balancing the inlets and outlets, a hydraulic system is obtained which can be controlled very well in dependence upon the process requirements. This embodiment is intended as a thickener of the suspension.

Figure 4:
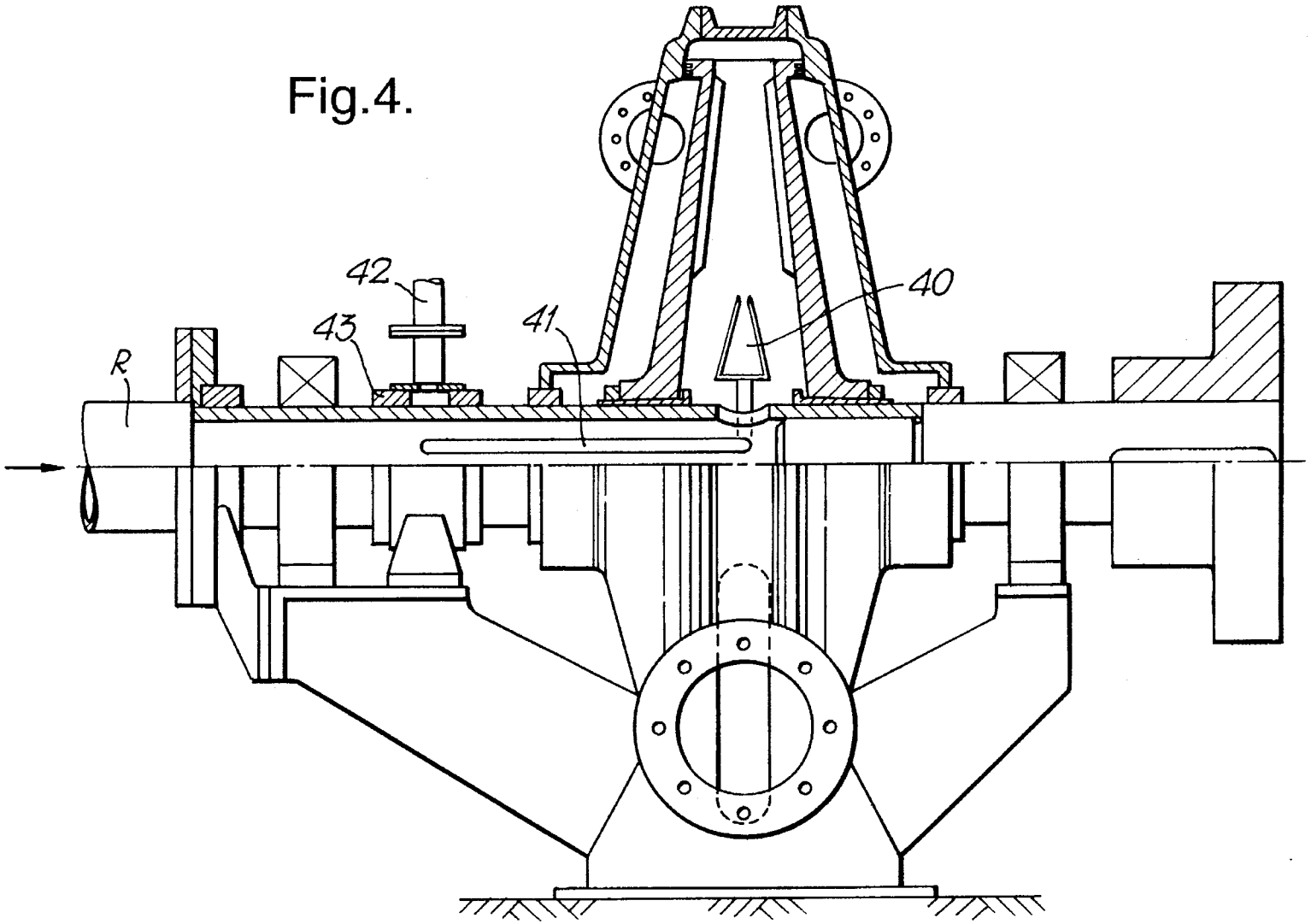
FIG. 4 shows the same view as FIG. 1, but for a second embodiment.
Figure 5:
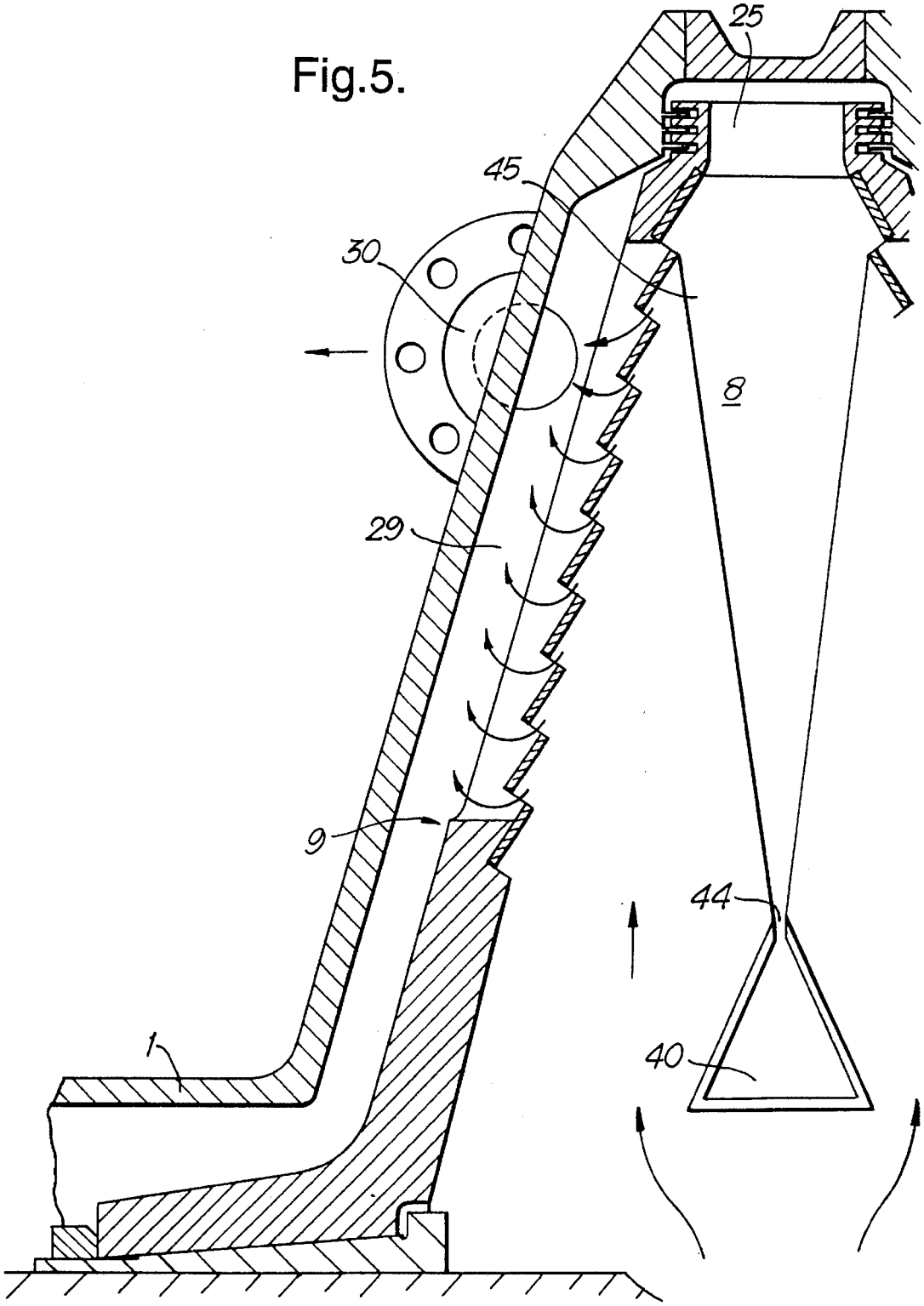
FIG. 5 shows the same view as FIG. 2, but for the second embodiment.

A second embodiment is shown in FIGS. 4 and 5. In this, the device is provided with a number of liquid distributors 40 placed in the lower part of the injection chamber 8, symmetrically between the wall members 9. Connected to these are pipes 41, which are drawn through the wall of the hollow pipe 5 and some distance along the inner wall of the axle, so as then to be linked via conduits to a liquid connection 42 for washing liquid, via a packing box 43 which seals around the axle in a known manner. Preferably, the pipe conduits between the axle 5 and the injection chamber 8 are placed between the openings 7 for the suspension. The liquid distributors 40 are configured having outlet openings or mouthpieces 44 directed towards the outer part 25 of the injection chamber 8, the acceptance space, which mouthpieces 44 are configured such 'that a liquid jet 45 having a relatively small discharge angle is formed:

This embodiment is intended for use in the washing of the suspension. In this embodiment, when the suspension enters the injection chamber 8, it is subjected, as described above, to centrifugal forces and is pressed against the walls of the wall members 9, so that the liquid in the suspension is pressed out through the slot-shaped openings 22. At the same time, new liquid is supplied from the liquid distributors 40, which further helps to expel the old liquid.

By virtue of the inclination of the wall members 9, there is thus obtained in the acceptance space 25 a suspension which can contain just as much liquid as previously, but which is mainly fresh.

It is also possible to conceive of the suspension in the acceptance space 25 containing less liquid than the untreated suspension, i.e. of the treatment comprising both washing and dehydration, as well as of it containing more liquid than the original suspension, i.e. of the treatment comprising washing and dilution. It should therefore be understood that the second embodiment having a liquid distributor can also be used as a thickener, i.e. without supplying any fresh liquid.

Since there is no desire, on the one hand, for the pulp suspension to be pulled apart, the angle a for the wall members 9 is important to the functioning of the device so as to ensure that a constant pressure should be obtained against the wall members 9 from the axle and out to the periphery, and especially along the separating members 20, and that the separating members 20 are not blocked up again by fibres. If a wash-water factor=1.0 is assumed, i.e. if it is assumed that, following washing treatment of the suspension according to embodiment two, there is an equal amount of liquid remaining, but exchanged for clean liquid, i.e. the outlet area (the area between the wall members 9) in the periphery is half the area at the inlet, and the clearance at the hub is 200 mm, then there is obtained, according to FIG. 6:

$$(500 \times p \times 200)/2 = 1400 \times p \times B,\ B = 36 \text{ mm}$$

$$\text{tang. } a = 82/450,\ a = 10.3°.$$

Figure 6:
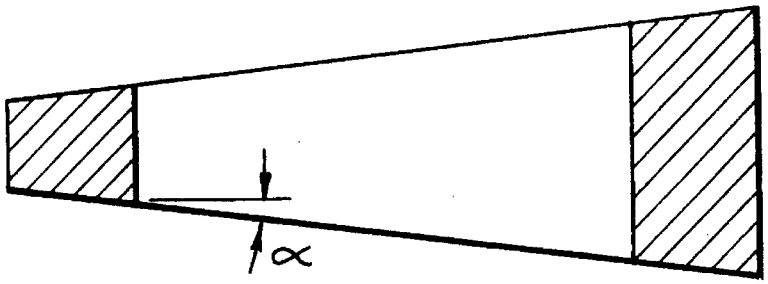
FIG. 6 illustrates the calculation of the inclination of the wall members.

If it is assumed that the pulp is homogenous and takes up a disc surface area of 1 $dm^2$, FIG. 6, and the distance between the discs at the axle is 200 mm, a height of 1.82 dm is obtained. The rotational speed is set at 1000 r.p.m. A centrifugal force at the hub is then obtained according to:

$$F_{hub1000} = 1.82\ (p \times 0.6\ (1000/60)^2/0.3 = 5988\ N.$$

The centrifugal force at the periphery: pulp height=36+2×9=54 mm, $$F_{per1000} = 0.54\ (p \times 1.3\ (1000/60)^2/0.65 = 3849\ N,$$

i.e. the centrifugal force is greater at the hub than at the periphery, which means that the bed is prevented from being pulled apart. Thanks to the inclination a, a constant pressure is obtained along the wall members out towards the periphery, which also, together with the configuration of the separating members, prevents the latter from becoming blocked, whilst the separating members simultaneously prevent the cellulose-containing pan of the suspension from being expelled through the separating members.

From what has been stated, it is evident that the invention should not be deemed to be limited to the above-described and to the preferred embodiments shown in the drawings, but can be the subject of various modifications within the scope of that specified by the following patent claims.

We claim:

1. Device for treating a preferably cellulose-containing suspension, comprising a housing (1) on a stand (2), characterized in that it comprises an injection chamber (8) limited by two disc-shaped wall members (9) mounted having an inner part on an axle (5) on one side each of a normal plane (S) to the axle and arranged to rotate about a centre of rotation (C) common to the axle, in that the distance between the wall members (9) decreases from the axle (5) and out towards their periphery, in that at least one inlet opening (7) is disposed in the inner part of the chamber (8) for the suspension to be treated, in that outlets (27) for the treated suspension are disposed in an outer part (25) (the acceptance space) of the injection chamber (8), in that an extraction chamber (29) is disposed outside the wall members (9) of the injection chamber (8), in that openings (22) for a filtrate are disposed between the injection chamber (8) and the extraction chamber (29) within at least one annular zone of the radial extent of the wall members (9), and in that outlets (30) for a filtrate are arranged from the extraction chambers (29).

2. Device according to claim 1, characterized in that the said normal plane is a plane of symmetry (S) in the injection chamber, and in that the inner walls (11) of the wall members (9) are straight and incline towards each other at a respective angle a to the said plane of symmetry (S).

3. Device according to claim 1, characterized in that the said wall members (9) are convexly or concavely shaped, having a mean angle of inclination a to the said plane of symmetry (S).

4. Device according to claim 1, characterized in that the axle (5) is hollow until at least the said normal plane (S), in that the said at least one inlet opening (7) is disposed between the hollow part of the axle (5) and the injection chamber (8), and in that the hollow end of the axle (5) is connected to a pipe system (R) of the suspension to be treated.

5. Device according to claim 1, characterized in that the inlet for the suspension to the axle (5) and the outlets (27, 30) are provided with regulating members (31, 32) for controlling the pressure in these, so as thereby to regulate the treatment of the cellulose-containing suspension in the device.

6. Device according to claim 1, characterized in that the injection chamber (8) is provided with a number of liquid distributors (40).

7. Device according to claim 6, characterized in that the liquid distributors (40) are placed in the inner part of the injection chamber (8) and have outlet openings (44) or mouthpieces directed towards the outer part (25) of the injection chamber (8).

8. Device according to claim 1, characterized in that an annular, peripheral part of the rotary wall members (9) and peripheral parts of the side wall (17) of the fixed housing (1) are provided with sealing members (16) for sealing off the wall members (9) against the housing (1).

9. Device according to claim 1, characterized in that the inner side (17) of the side wall of the housing (1) has essentially the same inclination and configuration as the wall members (9), so that the extraction chamber (29) acquires a slot-shaped appearance.

10. Device according to claim 1, characterized in that the angle of inclination a of the wall members (9) is within the range 5°–20°.

11. Wall member according to claim 10, characterized in that the apertures (19) in the wall member (9) are arranged with separating members (20) for separating off liquid from the suspension.

12. Wall member intended to form pan of a device for treating a preferably cellulose-containing suspension according to claim 1, characterized in that the wall member (9) has a disc-shaped segment (14) alongside the axle (5) and devices (10) for fastening this to the axle (5), and an annular part (15) at its periphery, and in that-the disc-shaped segment (14) and the annular part (15) are joined together by a number of supporting members (18), so that apertures (19) are formed within at least one annular zone of the radial extent of the wall member (9).

13. Wall member according to claim 11, characterized in that the separating members (20) are configured as annular lamellae placed radially one after the other and fixed on the supporting members (18) and angled such that their inner surfaces (21 ) have an angle b to the normal of the axle (5), and in that b>a, so that slot-shaped openings (22) are formed between the lamellae.

14. Wall member according to claim 11, characterized in that the separating members (20) consist of annular lamellae designed as truncated cones placed one after the other in the radially region of said at least one annular zone of the radial extent of the wall members, said truncated cones converging outwards in relation to the centre of rotation, each such truncated cone lying radially out of an other truncated cone having a base radius which is greater than the top radius of said other truncated cone, the said two truncated cones lying adjacent to each other having an annular space between them, the annular spaces defining said slot-shaped openings between the lamellae.

* * * * *